United States Patent [19]

Zaman et al.

[11] Patent Number: 4,923,133

[45] Date of Patent: May 8, 1990

[54] DANCER ASSEMBLY

[75] Inventors: Mohammad F. Zaman; James Gerencser, both of Ft. Wayne, Ind.

[73] Assignee: Essex Group, Inc., Fort Wayne, Ind.

[21] Appl. No.: 373,041

[22] Filed: Jun. 28, 1989

[51] Int. Cl.[5] ..... B65H 59/38

[52] U.S. Cl. ..... 242/45; 226/44

[58] Field of Search ..... 242/45, 75.5, 75.51, 242/75.52, 75.53, 75.43, 75.44, 156, 156.2; 226/44, 45

[56] References Cited

U.S. PATENT DOCUMENTS

| | | | |
|---|---|---|---|
| 2,237,112 | 4/1941 | Parvin | 242/45 |
| 2,608,355 | 8/1952 | Bell et al. | 242/45 |
| 2,752,105 | 6/1956 | Keith | 242/45 |
| 2,920,840 | 1/1960 | Cooper | 242/156.2 |
| 3,048,343 | 8/1962 | Keith | 242/45 |
| 3,384,322 | 5/1968 | Reed | 242/156.2 |
| 4,364,527 | 12/1982 | Bruno | 242/75.51 |
| 4,623,101 | 11/1986 | Cacak | 242/45 |

*Primary Examiner*—Stanley N. Gilreath

*Attorney, Agent, or Firm*—Allegretti & Witcoff, Ltd.

[57] ABSTRACT

A wire winding system includes a capstan assembly for drawing wire at a substantially constant speed and a wind-up unit turntable adapted to receive a spool upon which wire is adapted to be wound. Between the capstan assembly and the wind-up unit turntable is an adjustable wire wind-up tension control system for a plurality of wire gauges. The tension control system comprises dancer means including a dancer pulley, variable weight means, including a chain with a plurality of weights affixed to the chain, and wire gauge selection means, operatively connected to the dancer means and the chain for positioning the chain to apply the predetermined weight for a selected one of the plurality of wire gauges so that a predetermined tension is placed in the wire. A linear sensor is operatively connected to the dancer means for sensing the relative position of the dancer means and providing a signal. The wind-up unit turntable is driven by a variable torque motor which is operable in response to the signal from the linear sensor to vary the torque supplied to the wire winding turntable.

7 Claims, 3 Drawing Sheets

DANCER ASSEMBLY

BACKGROUND OF THE INVENTION

The present invention relates to a wire winding system and more particularly to a dancer assembly for use in a wire winding system for controlling the tension of the wire traveling from a point of manufacture to a take up reel.

In a wire winding system used in the manufacture of insulated wire, the wire is ordinarily advanced continuously by a capstan assembly from an extruder or enameler to a take-up mechanism. The capstan assembly operates at a substantially constant linear speed to draw the wire at substantially constant speed. The tension in the wire is substantially constant. The take-up mechanism includes one or more reels driven at variable speeds to compensate for the varying speeds necessary to take up wire on a reel of changing effective diameter and weight.

The wire passing from the capstan assembly to the take-up mechanism usually passes over a dancer unit, which is movable with variations in the take up speed of the wire to help compensate for the tension differences caused in the wire by the varying take-up speed. At higher operating speeds, on the order of 600–1100 feet per minute, substantial tension is imparted to the wire and it is imperative that the dancer unit operate quickly to prevent breaking of the wire, which could cause shut down of the wire winding system. The result would be manufacturing delays and waste of material.

Various means have been employed to control the tension of the wire in such wire winding system. In one known arrangement wire travels about a dancer weight unit where numerous loops are formed in the wire causing the weighted roller of the unit to move up and down with variations in the take up speed of the wire. See, for example, Wahl 3,038,674, Ludwig 3,169,715, and Tarulli 3,994,445. The wire undesirably passes over a plurality of pulleys and is work hardened. This is unwanted in many applications, for example, winding magnet wire. Another arrangement for controlling wire tension includes an air cylinder, which employs air pressure in opposition to the force of the wire against a pulley in the dancer unit. The air cylinder arrangement is somewhat complex and has been subject on occasion to leaks or loss of air pressure. It has been found difficult to control with reliability, particularly when very fine gauge wire is used. Another arrangement for controlling the wire tension involves applying weight to the dancer pulley in opposition to the force of the wire. A different weight is required for each gauge of wire. A plurality of separate weights are required and keeping tracking of the various loose weights has been a problem.

An object of the present invention is to provide an improved tension control arrangement for a wire winding system wherein the disadvantages and deficiencies of prior construction are obviated.

Another object of the present invention is to provide an improved tension control system for a wire winding system for handling selectively one of a plurality of wire gauges, which control system includes a dancer unit with a single pulley, variable weight means for applying weight to the dancer unit, and wire gauge selection means for positioning the variable weight means to apply a predetermined weight to the wire corresponding to a selected wire gauge.

Yet another object of the present invention is to provide an improved tension control system for a wire winding system including a dancer unit, a chain with a plurality of weights permanently affixed thereto, the weights calibrated to predetermined wire gauges, and calibration means operably connected to the chain to apply a predetermined weight to the dancer unit, said calibration means including a calibration knob having indicia thereon corresponding to the desired wire gauges to be run, and said calibration knob being rotatable to an index position corresponding to one of said indicia to apply a corresponding predetermined weight to said dancer unit.

Other objects and advantages of the present invention will be made more apparent hereinafter.

BRIEF DESCRIPTION OF THE DRAWINGS

There is shown in the attached drawing a presently preferred embodiment of the present invention, wherein like numerals in the various views refer to like elements and wherein.

DETAILED DESCRIPTION OF THE INVENTION

Figure 1:
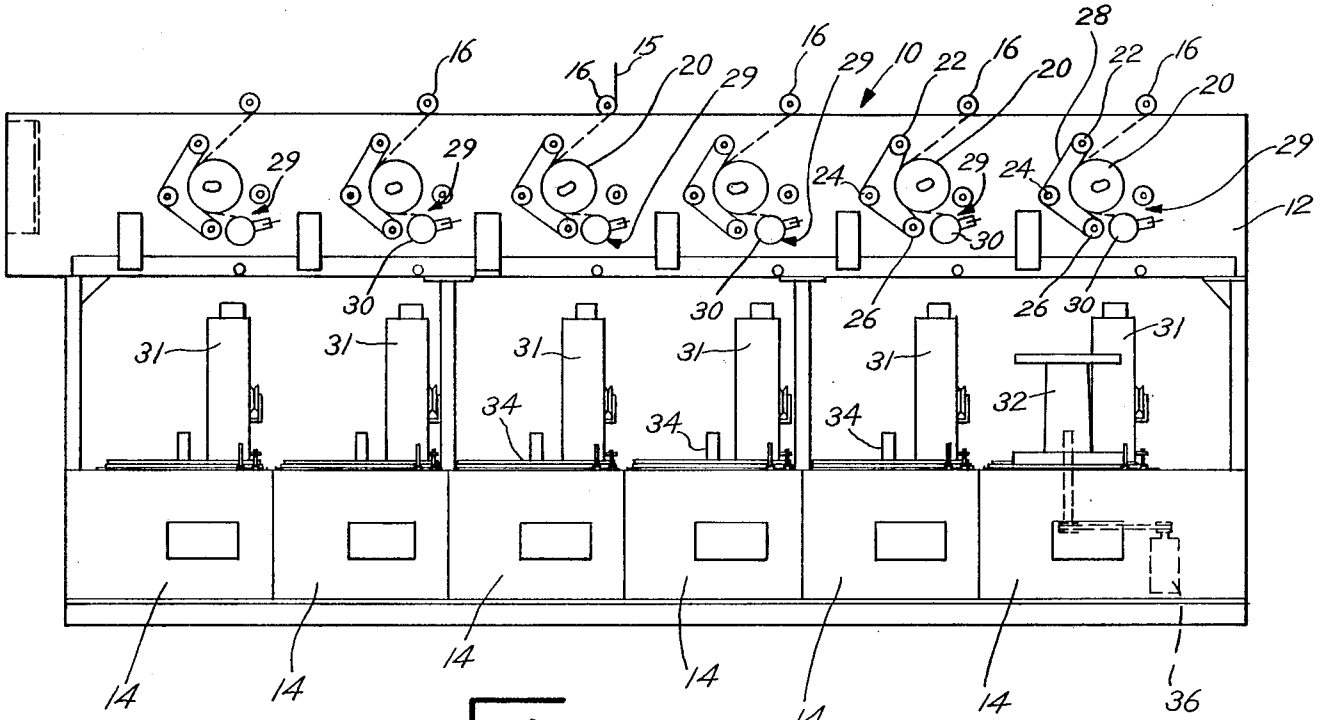
FIG. 1 is a side elevation of a wire winding machine embodying the dancer assembly of the present invention.

Referring now to FIG. 1, there is illustrated a wire winding system 10 which includes the adjustable wire wind-up tension control system of the present invention. The wire winding system 10 includes a main frame 12 having a plurality of wind-up stations 14 thereon. As illustrated, there are six wind-up stations on the main frame. Wire from a process operation such as an enameler or an extruder passes over the pulley 16 and then through the capstan assembly 18 which includes a capstan pulley 20 and a plurality of pulleys 22, 24 and 26 over which a belt 28 is trained. The belt 28 maintains the wire in contact with the capstan pulley 20. The capstan assembly 18 is adapted to be rotated at a constant speed so as to draw the wire from the process operation at a constant speed.

From the capstan assembly 18, the wire 15 passes over the dancer pulley 30, which is a part of the dancer unit 29 of the present invention. The wire passes from the dancer pulley 30 over a traverse mechanism 31 to the take up spool 32 on a turntable 34 at the first operating station. The traverse mechanism 31 is of the type shown in Lothamer 4,725,010, which is incorporated hereby by reference. The turntable 34 is adapted to be driven by a variable torque motor 36 operatively connected to the turntable in order to effectuate drawing of the wire on to the take up reel or spool 32 in a uniform manner.

Figure 2:
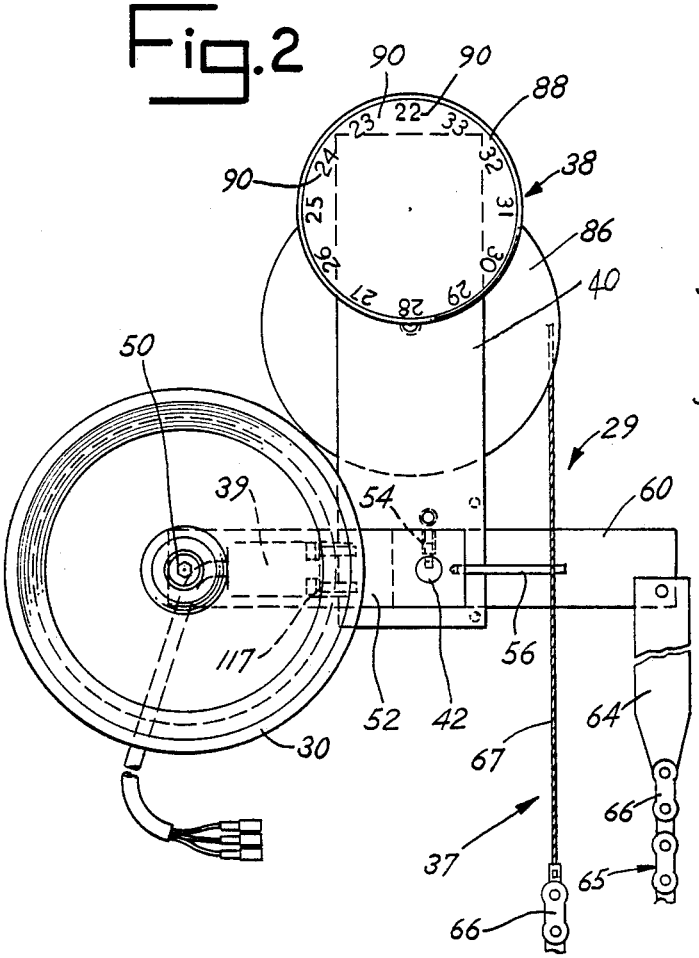
FIG. 2 is a front view of the dancer assembly.

Turning now to FIG. 2 there is better shown the dancer unit 29 of the present invention. The dancer unit 29 includes the dancer pulley 30, variable weight means 37 for applying a selected weight to the dancer pulley, which selected weight corresponds to one of a selected wire gauge and wire gauge selection means 38 operatively connected to the dancer pulley 30 and the variable weight means 37 for positioning the variable weight means in a proper position for a selected one of the plurality of wire gauges so that a predetermined tension is placed on the wire 15.

The dancer unit 29 includes a dancer means position sensor means 39 operatively connected to the dancer pulley 30 for sensing the relative position of the dancer pulley 30 and providing an electrical signal responsive thereto. The dancer means position sensor means 39 is operatively connected to the variable torque motor means 36 (FIG. 1) for varying the torque supplied to the wire wind-up reel 32 on the turntable 34 responsive to the signal provided by the sensormeans 39. The torque motor means 36 includes a torque motor and a solid state variable voltage controller associated therewith. The variable voltage controller varies the voltage to the torque motor in response to the voltage signal from the sensor means.

Figure 3:
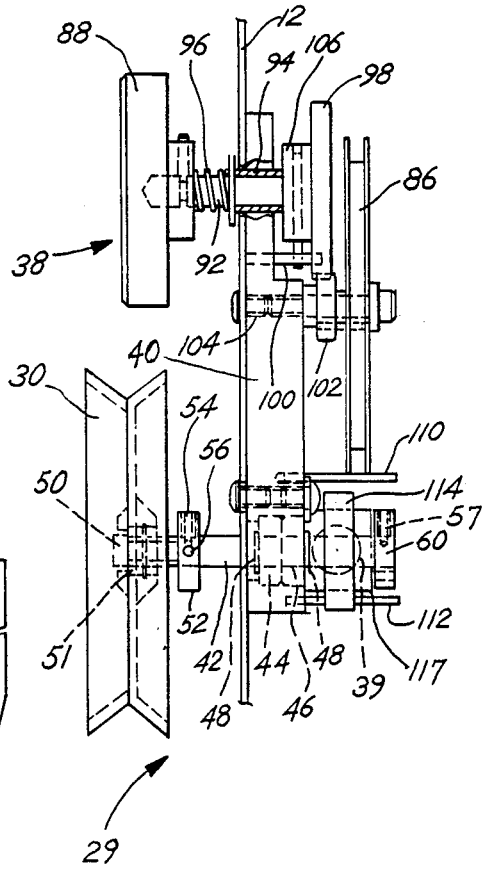
FIG. 3 is a side view of the dancer assembly of FIG. 2, with parts broken away for clarity.

With reference to FIGS. 2 and 3, it is seen that the dancer means 29 includes a dancer mounting block 40 that is secured to the frame 12 of the wire winding system 10. The dancer shaft 42 is rotatably journalled by bearings 44, 46 in the dancer mounting block 40. The bearings 44, 46 are retained in place by the snap rings 48, one at each side of the bearings. The pulley 30 is rotatably secured to an end of the pulley arm 52 by means of the shoulder bolt 50 and bearing 51. The other end of the pulley arm 52 is secured to the dancer shaft 42 by suitable means, for example, a set screw 54. An indicator pin 56 extends from the pulley arm 52 for the purpose of indicating whether or not the pulley is operating to maintain the desired tension in the wire, as well as to indicate any deviation from the desired tension. The indicator pin 56 is positioned adjacent a scale on the face of panel of frame 12 which indicates a set position. The axis of the bolt 50 is parallel to and spaced from the axis of the dancer shaft 42.

Chain arm 60 is secured adjacent one end to the dancer shaft 42 by suitable fastening means, such as set screw 57. Thus, both the pulley arm 52 and the chain arm 60 are secured to the dancer shaft 42, which forms a pivot for the arms 52 and 50. The variable weight means 37 is secured at one end to the chain arm 60 and at the other end to the wire gauge selection means 38. The variable weight means 37 includes a chain bar 64 that is pivotally connected to the chain arm 60 and is suspended from the chain arm 60. A predetermined number of weights are fixed to chain 65, which is comprised of a plurality of pivotally connected links 66. One of the weights 68 is shown in FIG. 2. The chain 65 includes the cable 67 which is connected at one end to a link of the chain 65 and at the other end to a cable drum 86.

The cable drum 86 forms a part of the wire gauge selection means 38. The wire gauge selection means 38 includes the calibrated knob 88 having a plurality of indicia thereon for a plurality of selected wire gauges. Each of the indicia 90 on the face of the calibrated knob 88 corresponds to a selected weight on the chain. In the embodiment illustrated, the indicia numerals 22–33 correspond to gauges of wire that can be used. The calibrated knob or hand knob 88 is secured to a shaft 92 that is journalled in a sleeve 94 in the dancer mounting block 40. The knob 88 is adapted to be moved inwardly against the bias of the spring 96 and to be biased outwardly to its normal position. Gear 98 is carried on the shaft 92 and is adapted to be moved into and out of engagement with the pin 100 secured to the dancer mounting block 40. There are a plurality of recesses in the face of the gear 98 which correspond in number to the indicia 90 on the face of the calibrated knob 88. Thus, in order to set a predetermined wire gauge, the calibrated 88 is pushed inwardly to disengage pin 100 from a recess in the face of the gear 98. If desired, openings may be formed through the gear instead of recesses in one face of the gear. The knob 88 is rotated util a selected indicia 90 is in the 12:00 o'clock position as indicated in FIG. 2. The hand knob 88 is released and the pin 100 will engage the selected recess so as to retain the gear 98 in desired position. The gear 98 engages the gear 102 on a shaft 104 secured to the dancr mounting block 40. Gear 102 is fastened to cable drum 86 which is also mounted on shaft 104. Also secured to the shaft 104 is the cable drum 86. It will be understood that upon rotation of the calibrated knob 88 gears 98 and 102 will be rotated in order to rotate the cable drum 86 so as to wind or unwind the variable weight means 37. In a present form of the invention, the ratio of gears 98 and 102 is such that one rotation of the hand knob 88 will effect three rotations of the cable drum 86. Secured to the shaft 92 is a one revolution stop means 106 comprising a pin which is adapted to contact the pin 100 on the dancer mounting block 40. Since the one revolution stop means is secured to the shaft 92, this will effectively limit the rotation of the calibrated knob 88.

Projecting from the dancer mounting block 40 are a pair of pins 110, 112, which act as stop pins to limit the rotation of the chain arm 60 about the axis of the dancer shaft 42. Mounted on the dancer shaft 42 for rotation therewith is a dancer cam 114. The dancer cam 114 is adapted to cooperate with the dancer means position sensor means or linear output transducer 39, which is held in place by bracket 117. The liner output transducer 39, which may be a Honeywell Model PK 82760 Microswitch device, will provide an output voltage signal proportional to the relative position of the dancer cam 114 with respect to the transducer 39 so that when the wire tension is above the predetermined tension, the torque output of the variable torque motor will be reduced and when the tension is below the predetermined tension, the output of the variable torque motor will be increased in order to maintain the predetermined wire tension on the wire being wound up on the take up reel 32 shown in FIG. 1.

Figure 4:
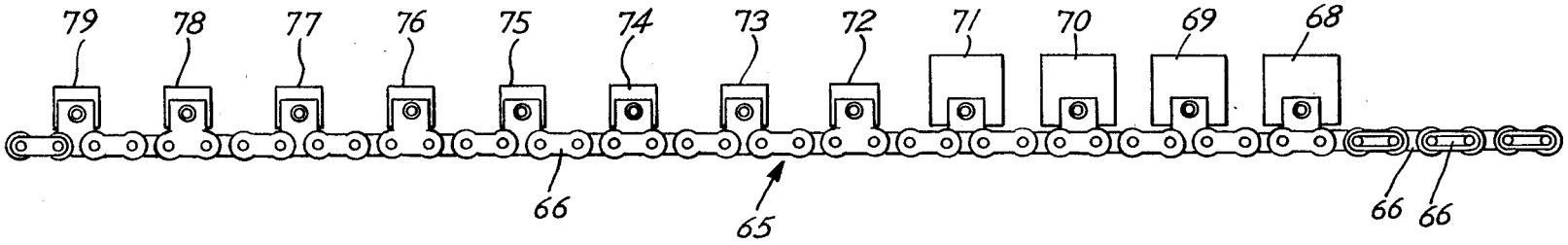
FIG. 4 is a side view of the tension chain assembly used in the dancer assembly of this invention.

With reference now to FIG. 4 there is better shown the chain assembly of the present invention. The chain 65 includes a plurality of links 66 pivotally connected to one another in a known fashion. In the embodiment shown, there are twelve weights 68–79. These weights correspond to the indicia on the face of the calibrated knob 88 which indicate wire gauges from 22 to 33 gauge. The chain 65 may also be any flexible member, such as a cable, to which a plurality of weights are secured.

Figure 5:
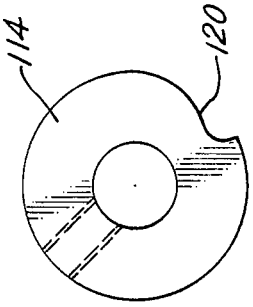
FIG. 5 is a plan view of the dancer cam.

Turning now to FIG. 5, there is illustrated the dancer cam 114 of the present invention. The peripheral surface of the dancer cam 114 is substantially circular. The cam surface 120 is formed commencing at approximately the 3:00 o'clock position and continuing to the 5:00 o'clock position. The linear output transducer 39 is operated by its proximity to the cam surface 120 of the dancer cam 114 and is responsive to the movement thereof as the dancer shaft 42 rotates in operation responsive to the movement of dancer pulley 30 so as to provide an electrical signal that is proportional to the position of the dancer pulley 30 to maintain a proper tension on the wire 15 trained over the dancer pulley 30. The liner output transducer 39 is preferably of the inductive type and operates to provide a linear output voltage that is directly proportional to the cam distance from the sensing face of the transducer 39.

The operation will now be briefly described. The calibrated knob 88 is pushed inwardly and rotated to the desired wire gauge as indicated by an indicia 90 in the 12:00 o'clock position on the face of the calibrated knob. As the knob 88 is rotated, the gear 102 and the cable drum 86 are also rotated. The chain 65 is wound onto or from cable drum 86 so as to place a predetermined weight on the end of the chain arm 60. With the lowest numbered indicia e.g. 22, all the weight of the chain 65 (including the weights thereon) is on the chain arm 60. With the highest number indicia, e.g. 33 in the illustrated embodiment, virtually all of the weight of the chain 65 is on cable drum 86.

In operation wire 15 is drawn over the dancer pulley 30. The chain arm 60 and the pulley arm 52 are secured to the dancer shaft 42, which functions as a pivot. The position of the dancer pulley 30 is changed in response to changing tension in the wire 15. As the chain arm 60 pivots, the dancer cam 114 is moved responsive thereto. The linear output transducer 39 will sense the motion of the dancer cam 114 and provide an output voltage signal to the torque motor means 36 that is proportional to the relative position of the cam surface 102 of the dancer cam 114 with respect to the linear output transducer 39. When the wire tension is above the predetermined desired tension, the torque output of the torque motor of the variable torque motor means 36 is reduced and when the tension is below the predetermined tension, the output of the torque motor of the variable torque motor means 36 is increased so as to maintain the wire tension.

By the present invention, there has been provided a tension control system utilizing a plurality of weights retained in a coordinated manner on a chain, or like elongated flexible member, which weights may be readily adjusted to accommodate a plurality of different wire gauges to maintain proper wire tension for a selected gauge of wire.

While a presently preferred embodiment of the invention has been shown and described, it is apparent that various changes and modifications may be made therein without the departing from the invention. Therefore, it is intended to the appended claims to cover all such changes and modifications as fall within the true spirit and scope of the invention.

What is claimed:

1. In a wire winding system including a wind-up unit turntable adapted to receive a spool upon which wire is adapted to be wound, an adjustable wire wind-up tension control system for a plurality of wire gauges, said tension control system comprising:

dancer means;

variable weight means;

wire gauge selection means, operatively connected to the dancer means and the variable weight means, for positioning the variable weight means in the proper position of a selected one of the plurality of wire gauges so that a predetermined tension is placed in the wire;

dancer means position sensor means, operatively connected to the dancer means, for sensing the relative position of the dancer means and providing a signal; and variable torque motor means, operatively connected to a wire wind-up unit turntable and the sensor means, for varying the torque supplied to the wire wind-up turntable responsive to the signal provided by the sensor means.

2. The system of claim 1 wherein said dancer means further comprises:

a dancer shaft means;

a dancer pulley rotatably mounted on the dancer shaft means;

an elongated dancer arm, pivotally connected to the dancer shaft means at one end and to the variable weight means at the other end, for indicating variance in the wire tension from the predetermined desired wire tension; and a dancer cam operatively connected to the dancer shaft means.

3. The system of claim 2 wherein the dancer cam means is rigidly secured to the dancer shaft means for rotation therewith.

4. The system of claim 2 wherein the variable weight means further comprises:

a cable drum rotatable about a cable drum shaft;

a cable operatively connected to the cable drum; and a chain having a predetermined number of different weights attached thereto, the chain being operatively connected to the cable at one end and the dancer means at the outer end so variable weight means is selectively supported in varying amounts of weight from both the dancer arm and the cable drum.

5. The system of claim 4 wherein the wire gauge selection means further comprises:

a calibrated knob having indicia thereon for a plurality of selected wire gauges;

a knob shaft;

said knob being operatively secured to said knob shaft;

at least two gears, one of said gears herein operatively connected to the knob shaft and the other gear being operatively connected to the cable drum shaft, for rotating the cable drum to a predetermined position corresponding to one of the plurality of wire gauges, thereby varying the length of the chain and the number of weights being supported by the dancer arm.

6. The system of claim 5 wherein the dancer means position sensor means further comprises:

a transducer linear output mechanism which provides an output proportional to the relative position of the dancer cam so that when the wire tension is above the predetermined tension, the torque output of the variable torque motor means is reduced and when the said tension is below the predetermined tension, the output of the variable torque motor means is increased to maintain the predetermined wire tension.

7. The system of claim 4 wherein said of one of said gears has a plurality of recesses in the face thereof, a pin engageable in a selected one of said recesses, a spring for biasing said calibrated knob so as to engage said pin in one of said recesses, said recess corresponding to a desired wire gauge as evidenced by indicia on the calibrated knob, whereby said calibrated knob may be moved to disengage said one of said gears from said pin, then rotated to indicate a desired wire gauge, and then released to permit the spring to move the calibrated knob and said one said gears to enable the pin to engage within a recess corresponding to said desired wire gauge.

* * * * *